US009765975B2

(12) United States Patent
Knöpfel et al.

(10) Patent No.: US 9,765,975 B2
(45) Date of Patent: Sep. 19, 2017

(54) COMBUSTION CHAMBER AND METHOD FOR OPERATING A COMBUSTION CHAMBER

(75) Inventors: Hans Peter Knöpfel, Döttikon (CH); Adnan Eroglu, Untersiggenthal (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 1060 days.

(21) Appl. No.: 13/233,369

(22) Filed: Sep. 15, 2011

(65) Prior Publication Data

US 2012/0073305 A1 Mar. 29, 2012

(30) Foreign Application Priority Data

Sep. 24, 2010 (EP) ..... 10179451

(51) Int. Cl.
*F23R 3/34* (2006.01)
*F23R 3/28* (2006.01)

(52) U.S. Cl.
CPC ..... *F23R 3/346* (2013.01); *F23R 3/286* (2013.01); *F23C 2900/07002* (2013.01); *F23N 2037/02* (2013.01); *F23R 2900/00013* (2013.01)

(58) Field of Classification Search
CPC .... F02C 9/34; F02C 9/26; F02C 7/228; F02C 7/22; F23R 3/04; F23R 3/10; F23R 3/286; F23R 3/34; F23R 3/343; F23R 3/346; F23R 2900/03341; F23R 2900/03343
USPC ..... 60/39.826, 725, 39.281, 776, 737, 738, 60/746–747
See application file for complete search history.

(56) References Cited

U.S. PATENT DOCUMENTS

| | | | | |
|---|---|---|---|---|
| 4,587,809 | A | 5/1986 | Ohmori et al. | |
| 4,735,052 | A | 4/1988 | Maeda et al. | |
| 5,274,993 | A * | 1/1994 | Keller | 60/39.37 |
| 5,490,380 | A | 2/1996 | Marshall | |
| 5,642,621 | A | 7/1997 | Alary et al. | |
| 5,983,643 | A * | 11/1999 | Kiesow | 60/746 |
| 6,058,710 | A * | 5/2000 | Brehm | 60/747 |
| 6,915,640 | B2 * | 7/2005 | Jonsson | 60/776 |
| 7,707,833 | B1 * | 5/2010 | Bland et al. | 60/737 |
| 2004/0060301 | A1 | 4/2004 | Chen et al. | |

(Continued)

FOREIGN PATENT DOCUMENTS

| | | |
|---|---|---|
| DE | 4336096 A1 | 5/1994 |
| EP | 0687864 A2 | 12/1995 |

(Continued)

OTHER PUBLICATIONS

Notification of Reasons for Refusal issued on May 11, 2015 by the Japanese Patent Office in corresponding Japanese Patent Application No. 2011-201943, and an English translation thereof (7 pages).

*Primary Examiner* — Andrew Nguyen
(74) *Attorney, Agent, or Firm* — Buchanan Ingersoll & Rooney PC

(57) ABSTRACT

A combustion chamber of a gas turbine including first and second premixed fuel supply devices connected to a combustion device having first zones connected to the first premixed fuel supply devices and second zones connected to the second premixed fuel supply devices. The second fuel supply devices are shifted along a combustion device longitudinal axis with respect to the first fuel supply devices. The first zones are axially upstream of the second premixed fuel supply devices.

17 Claims, 6 Drawing Sheets

(56) References Cited

U.S. PATENT DOCUMENTS

| | | | | |
|---|---|---|---|---|
| 2004/0131986 | A1* | 7/2004 | Stalder | F23R 3/286 431/278 |
| 2006/0016198 | A1* | 1/2006 | Stuttaford et al. | 60/776 |
| 2006/0101814 | A1* | 5/2006 | Saitoh et al. | 60/377 |
| 2007/0031768 | A1* | 2/2007 | Schefer et al. | 431/4 |
| 2007/0175219 | A1* | 8/2007 | Cornwell et al. | 60/737 |
| 2010/0170254 | A1 | 7/2010 | Venkataraman et al. | |
| 2010/0275603 | A1 | 11/2010 | Saito et al. | |

FOREIGN PATENT DOCUMENTS

| | | | |
|---|---|---|---|
| GB | 2010408 | A | 6/1979 |
| WO | 2009084587 | A1 | 7/2009 |

* cited by examiner

COMBUSTION CHAMBER AND METHOD FOR OPERATING A COMBUSTION CHAMBER

RELATED APPLICATION

The present application hereby claims priority under 35 U.S.C. Section 119 to European Patent application number 10179451.9, filed Sep. 24, 2010, the entire contents of which are hereby incorporated by reference.

FIELD OF INVENTION

The present invention relates to a combustion chamber and a method for operating a combustion chamber. In the following, particular reference to premixed combustion chambers is made, i.e. combustion chambers into which a fuel already mixed with an oxidiser is burnt.

BACKGROUND

With reference to FIGS. 1 and 2, which show traditional combustion chambers, premixed combustion chambers 1 comprise a plurality of mixing devices 2*a*, 2*b* all connected to a front plate 3 of a combustion device (thus all the mixing devices 2*a*, 2*b* have the same axial position with respect to a longitudinal axis of the combustion chamber 1).

Typically the mixing devices 2*a*, 2*b* are arranged in one, two or more rows around the combustion device and are connected to a fuel supply circuit in groups of three, four or five mixing devices, each group includes a plurality of mixing devices 2*a* and usually one or two mixing devices 2*b*.

During operation, the mixing devices 2*a* are supplied with the nominal amount of fuel and, in order to counteract pulsations, the mixing devices 2*b* are supplied with a reduced amount of fuel, such that they are operated at a lower temperature; in other words the temperature of the flame generated by the mixture formed in the mixing devices 2*b* is lower than the temperature of the flame generated by the mixture formed in the mixing devices 2*a*.

This structure limits the regulation possibilities, in particular at part load.

In this respect, FIG. 3 shows the relationship between power and flame temperature in a traditional gas turbine; $T_p$ indicates the critical flame temperature below which large pulsations are generated within the combustion chamber.

From this figure it is clear that when operating at full power, the operating point 5 has a flame temperature $T_f$ well above the flame temperature $T_p$, such that safe operation can be carried out.

Nevertheless, when the required power decreases (i.e. at part load), the operating point 5 moves along a line 7 towards the temperature $T_p$.

Since the flame temperature $T_f$ must always be above the temperature $T_p$, a minimum power $P_{min}$ can be identified, such that safe operation at a lower power is not possible, because it would cause large pulsations that would inevitably damage the gas turbine.

It is clear that $P_{min}$ should be as low as possible, because in case only a very small power is needed (like in some cases during night operation of power plants) a substantial amount of the power produced is wasted; typically $P_{min}$ can be as high as 30% and in some cases 40% of the full power.

In order to increase the operating windows and safely operate the gas turbine at low power, combustion chambers are often provided with pilot stages.

Pilot stages consist of fuel injectors within the mixing devices; since pilot stages are only arranged to inject fuel (i.e. not a mixture of a fuel and oxidiser), they generate a diffusion flame that, on the one hand, helps to stabilize the combustion of the lean mixture generated at part load within the mixing devices, but on the other hand, causes high $NO_x$ emissions.

Alternatively, US 2010/0170254, which is incorporated by reference, discloses a combustion chamber with mixing devices supplying an air/fuel mixture into a combustion device (to generate a premixed flame). At the end of the combustion device, a second stage made of fuel and air injectors is provided; fuel and air are injected separately such that they generate a diffusion flame (i.e. not a premixed flame). Again, diffusion flames cause high $NO_x$ emissions.

U.S. Pat. No. 5,983,643, which is also incorporated by reference, discloses a combustion chamber with premixed fuel supply devices that are shifted along the combustion device longitudinal axis, but the flames generated by burning the mixture generated by all the mixing devices are downstream of all mixing devices.

SUMMARY

The present disclosure is directed to a combustion chamber of a gas turbine including first and second premixed fuel supply devices connected to a combustion device having first zones connected to the first premixed fuel supply devices and second zones connected to the second premixed fuel supply devices. The second fuel supply devices are shifted along a combustion device longitudinal axis with respect to the first fuel supply devices, the first zones are axially upstream of the second premixed fuel supply devices.

In another aspect, the present disclosure is directed to a method of operating a combustion chamber of a gas turbine having first and second premixed fuel supply devices connected to a combustion device that has first zones connected to the first fuel supply devices and second zones connected to the second premixed fuel supply devices. The method includes shifting the second premixed fuel supply devices along a combustion device longitudinal axis with respect to the first premixed fuel supply devices. The method also includes providing the first zones axially upstream of the second premixed fuel supply devices.

BRIEF DESCRIPTION OF THE DRAWINGS

Further characteristics and advantages of the invention will be more apparent from the description of a preferred but non-exclusive embodiment of the combustion chamber and method illustrated by way of non-limiting example in the accompanying drawings, in which:

FIG. 4 is a cross section through line IV-IV of FIG. 5;

FIG. 6 is a cross section through line VI-VI of FIG. 7

DETAILED DESCRIPTION OF THE PREFERRED EMBODIMENTS

Introduction to the Embodiments

Figure 1:
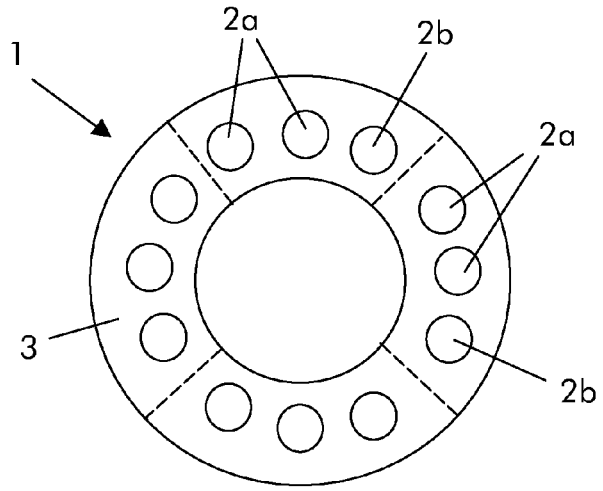
Fig. 1 Prior art
FIGS. 1 and 2 are schematic front views of traditional combustion devices.
Figure 2:
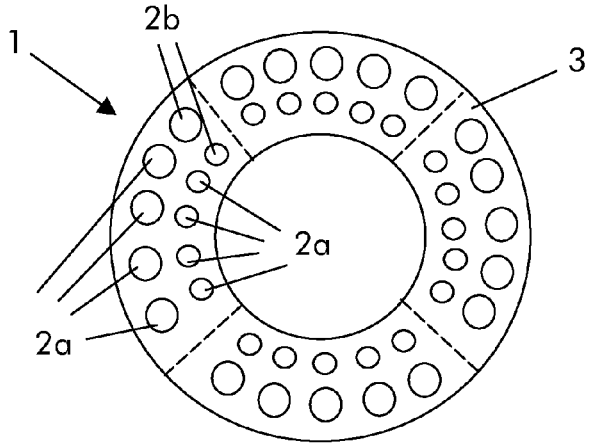
Fig. 2 Prior art
Figure 3:
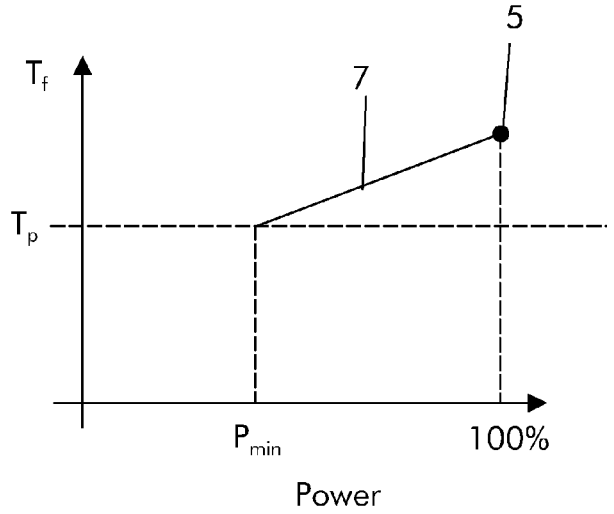
Fig. 3 Prior art
FIG. 3 shows the relationship between power and flame temperature for a traditional combustion chamber.

A technical aim of the present invention therefore includes providing a combustion chamber and a method addressing the aforementioned problems of the known art.

Within the scope of this technical aim, an aspect of the invention is to provide a combustion chamber and a method which allow safe operation at part load, without the need of using a pilot stage or only with a limited use of it and without generating a diffusion flame at a downstream part of the combustion chamber.

Another aspect of the invention is to provide a premixed combustion chamber and a method allowing a very broad operating window, from very low load to high load and full load.

The technical aim, together with these and further aspects, are attained according to the invention by providing a combustion chamber and method in accordance with the accompanying claims.

Detailed Description

With reference to the figures, which show a combustion chamber of a gas turbine; for sake of simplicity, the compressor upstream of the combustion chamber and the turbine downstream of the combustion chamber are not shown.

The combustion chamber 10 has first and second premixed fuel supply devices 11, 12 connected to a combustion device 13 that has first zones 14 that are connected to the first fuel supply devices 11 and second zones 15 that are connected to second fuel supply devices 12.

The second fuel supply devices 12 are located downstream of the first fuel supply devices 11 along a combustion device longitudinal axis 16 (in the direction of the hot gases G circulating within the combustion chamber); the first zone 14 are located upstream of the second zones 15.

In particular, the first and second fuel supply devices 11, 12 are mixing devices wherein the fuel F and the oxidiser A (typically air) are fed and mixed to generate a mixture that is then burnt in the combustion device 13 (i.e. the combustion chamber 10 is a premixed combustion chamber).

In particular the mixing devices 11, 12 have a substantially conical shape with tangential slots for air entrance within it and nozzles close to the slots for fuel (gaseous fuel) injection; in addition a lance is also usually provided, extending axially within the mixing devices 11, 12 for fuel injection (liquid fuel).

Naturally, also different mixing devices 11, 12 can be used, provided that they are premixed mixing devices, i.e. mixing devices into which a fuel and oxidiser are fed and are mixed to form a mixture that is then burnt within the combustion device 13 wherein they generate a premixed flame.

Advantageously the first zones 14 are axially upstream of the second premixed fuel supply devices 12, such that the flame generated by burning the mixture generated in the first fuel supply devices 11 is housed axially upstream of the second fuel supply devices 12.

Advantageously, each first fuel supply device 11 (thus also each first zone 14) is adjacent to at least a second fuel supply device 12 (thus also each second zone 15).

Figure 4:
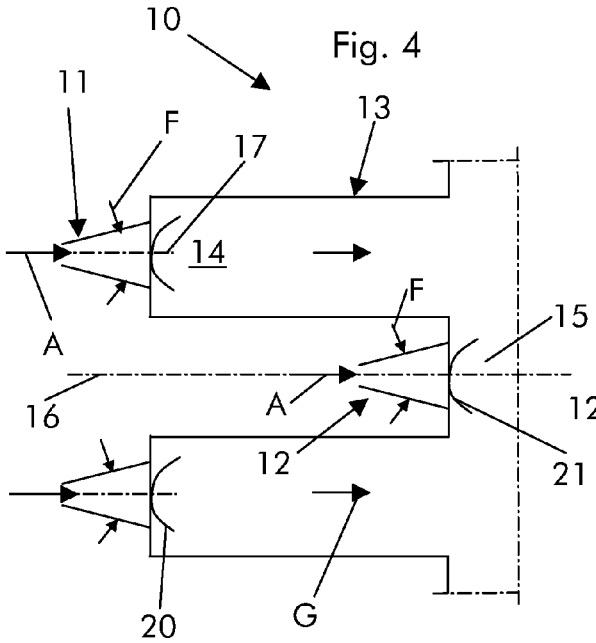
FIGS. 4-5 show a combustion chamber in a first embodiment of the invention.
Figure 5:
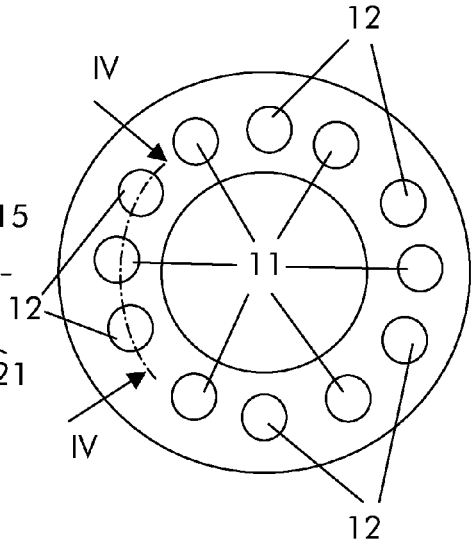

FIGS. 4 and 5 show a first embodiment of the combustion chamber; in this embodiment the fuel supply devices 11, 12 have different circumferential positions and, for example, they are placed in one single row and are alternated one another (i.e. there are provided in sequence a mixing device 11, a mixing device 12, a mixing device 11, again a mixing device 12 and so on).

Figure 6:
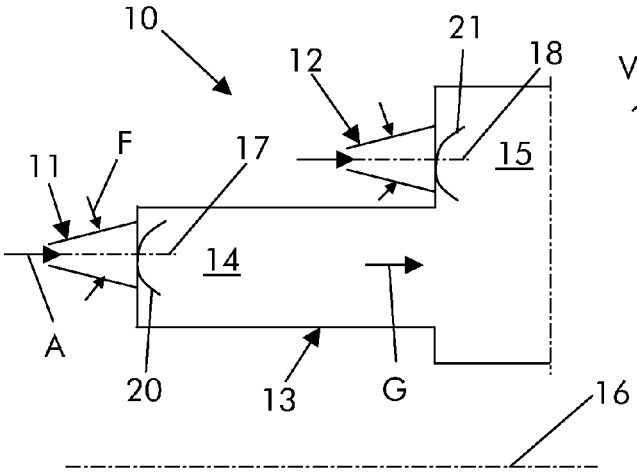
FIGS. 6-7 show a combustion chamber in a second embodiment of the invention.
Figure 7:
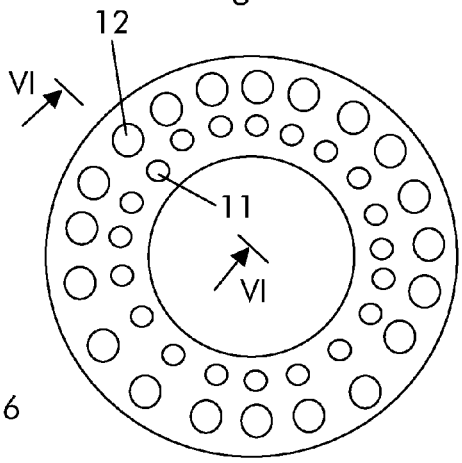

FIGS. 6 and 7 show a different embodiment of the combustion chamber, in which the first and second zones 14, 15 have different radial positions.

Figure 8:
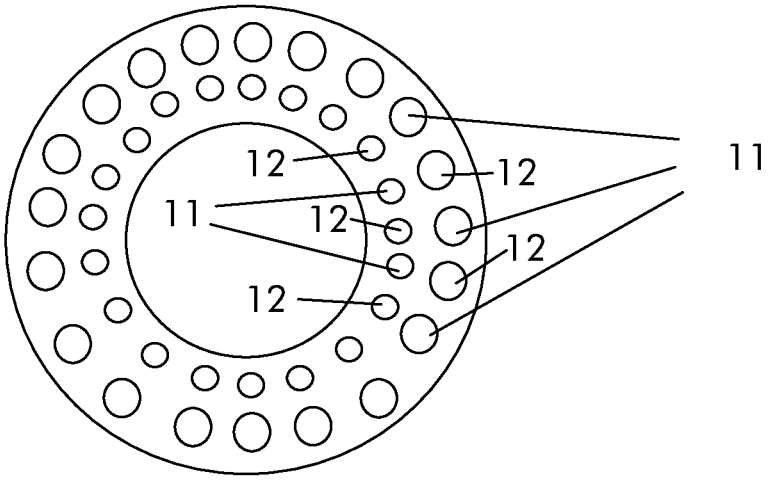
FIG. 8 shows a combustion chamber in a third embodiment of the invention.

Naturally different configurations are also possible and in particular combinations of those configurations previously described, with first and second zones having different radial and circumferential positions are possible; for example FIG. 8 shows one of such embodiments.

The mixing devices 11, 12 have parallel longitudinal axes 17, 18 and inject the mixture along these axes 17, 18; these axes 17, 18 are in turn also parallel to the combustion device longitudinal axis 16.

The operation of the combustion chamber is apparent from that described and illustrated and is substantially the following.

Within the mixing devices 11, 12 the fuel F and the oxidiser A are fed, such that they mix forming a mixture that is then burnt within the combustion device 13 generating a premixed flame; in particular the mixing devices 11 generate first flames 20 within the first combustion device zones 14 and the mixing devices 12 generate second flames 21 within the second combustion device zones 15.

Advantageously, operation is carried out such that the first mixing devices 11 are operated at a temperature that is higher than the operation temperature of the second mixing devices; in other words, the first mixing devices are operated with a richer mixture than the mixing devices 12, such that the temperature of the flame 20 is higher than the temperature of the flame 21 and, consequently, the temperature of the hot gases generated by the flame 20 is higher than the temperature of the hot gases generated by the flame 21.

This operating mode allows safe operation with a very lean mixture at the second mixing devices 12, since combustion (that could be troubling because the very lean mixture at the second mixing devices 12 can cause CO and UHC emissions) can be supported by the hot gases coming from the first zones 14.

This can be particularly advantageous at part load, when the fuel provided to the combustion chamber 10 must be reduced to comply with the reduced load. For example the following different operating modes at part load are possible.

Operation at Part Load—Very Low Power

Figure 9:
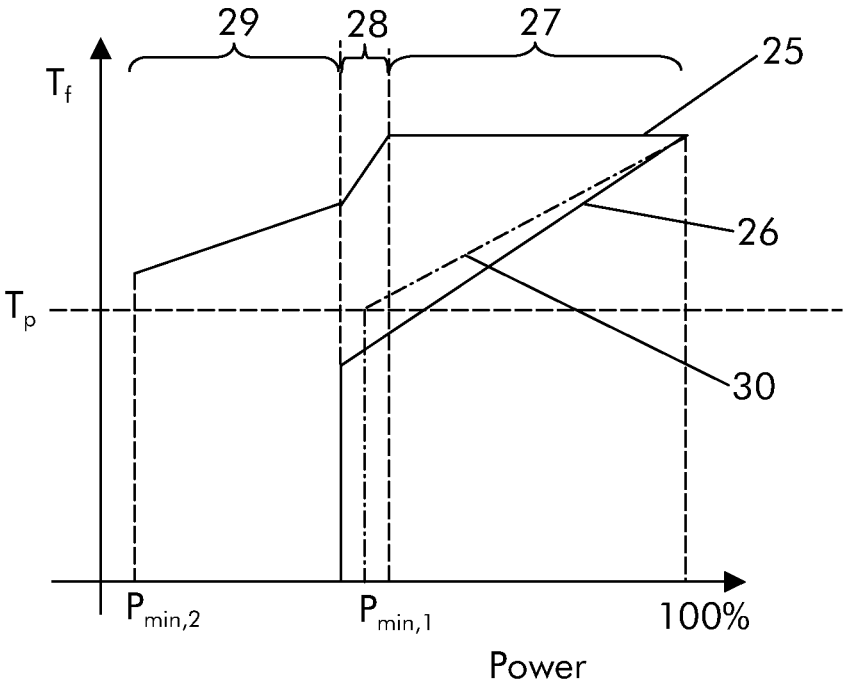
FIG. 9 shows the relationship between power and flame temperature ($T_f$) for a combustion chamber in an embodiment of the invention operating a very low load (part load).

In the following reference to FIG. 9 is made, which shows the relationship between flame temperature ($T_f$) and power; curve 25 refers to the flame temperature within the first zones 14 and curve 26 refers to the flame temperature within the second zones 15; $T_p$ indicates the critical flame temperature below which large pulsations are generated (with traditional combustion chambers operation below this flame temperature is not possible).

At full power (100%) all mixing devices 11, 12 are operated to generate a flame with a design flame temperature.

If the power must be reduced (i.e. the gas turbine must be operated at part load) the first mixing devices 11 are not regulated (i.e. they maintain their operating parameters or are only slightly regulated), and only the second mixing devices 12 are regulated, by reducing the fuel provided to them, to reduce the flame temperature within the second zones 15 and, consequently also the power generated (i.e. operation occur within zone 27).

In a preferred (but not required) embodiment this regulation can be employed in a very broad window without pulsation problems; in fact, even when, because of the reduction of the fuel supplied into the second mixing devices 12, the flame temperature within the second zones 15 become lower than the $T_p$, the combustion is still stabile and does not cause high CO or UHC emissions, since the hot gases coming from the first zones 14 enter the second zones 15 supporting the combustion and helping to completely burn CO and UHC.

Then, when the mixture generated within the second mixing devices 12 is very lean, simultaneous regulation of the first and second mixing devices 11, 12 is possible (in any case this regulation is optional, zone 28) until the second mixing devices 12 are switched off.

Then, if the power must be further reduced, regulation of the first mixing devices 11 can be carried out, by reducing the amount of fuel supplied to them, thus further reducing the power (zone 29).

Since the first mixing devices 11 are operated well above the temperature $T_p$, combustion is stable with CO and UHC emissions below the limits.

Advantageously, this regulation allows the gas turbine to be safely operated at a very low power (as low as 20% or even less).

The advantage of this operating mode is particularly evident when curve 30 (referring to the flame temperature of a traditional gas turbine with all mixing devices regulated together) is compared with curves 25, 26; it is evident that the lowest power at which a traditional gas turbine can be safely operated is $P_{min,1}$ (corresponding to the intersection of the curve 30 with $T_p$) whereas a gas turbine in embodiments of the invention can be safely operated up to $P_{min,2}$ that is much lower than $P_{min,1}$.

Operation at Part Load—CO Control

During operation at part load (in particular close to the LBO, lean blow off or lean blow out, i.e. operation with a very lean mixture close to flame extinction) the CO emissions increase and the $NO_x$ emissions decrease; typically CO emissions largely increase before pulsations start to be a problem.

The combustion chamber in embodiments of the invention can be safely operated at low load with a very lean mixture avoiding large CO emissions (without pulsations and very low $NO_x$ emissions).

Figure 10:
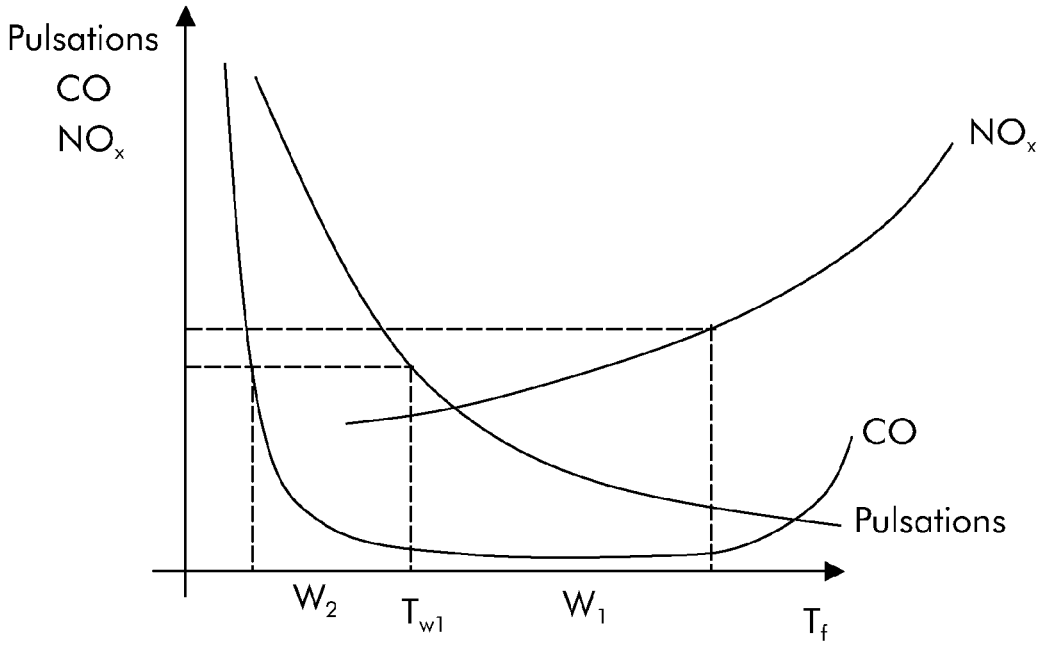
FIG. 10 shows the relationship between flame temperature ($T_f$) and $CO/NO_x$/pulsations for a combustion chamber in an embodiment of the invention operating at low load (part load)

With reference to FIG. 10, a diagram showing the relationship between pulsations, $NO_x$, CO and the flame temperature $T_f$ is shown.

As known pulsations increase with decreasing flame temperatures $T_f$, $NO_x$ increase with increasing flame temperatures $T_f$ and CO increase with both decreasing and increasing flame temperatures $T_f$ (i.e. there is an operating window $W_1$ in which the combustion chamber can be operated with low CO emissions).

Traditional combustion chambers are operated within the window $W_1$; it is clear that since the window $W_1$ imposes a lower limit for the flame temperature ($T_{w1}$) the power cannot be reduced such that the flame temperature goes below $T_{w1}$.

The combustion chamber in embodiments of the invention can be safely operated while generating a power lower than a power corresponding to the temperature $T_{w1}$.

In particular, the first mixing devices 11 can be operated within the window $W_1$ (i.e. they generate within the first zones 14 a flame with flame temperature within the window $W_1$).

In contrast, the second mixing devices 12 are operated at a temperature below $T_{w1}$, i.e. outside of the window $W_1$.

In particular safe operation of the second mixing devices 12 is possible within the window $W_2$, i.e. an operating window having as an upper limit the $T_{w1}$ (but the upper limit may also be higher and windows $W_1$ and $W_2$ may overlap) and a lower limit compatible with pulsations.

During operation the hot gases coming from the first zones 14 support the combustion in the second zones 15 and help to burn the CO generated therein; since the operation of all mixing devices 11, 12 is compatible with the pulsations, and since the flame temperatures are generally low (in particular for the second mixing devices operating within the window $W_2$), pulsations and $NO_x$ are generally very low and within the limits and power can be regulated at a very low level.

Operation at Part Load—High Load

During operation at part load (typically high load), in some cases, traditional combustion chambers cannot be operated with a flame temperature needed to achieve a required power, since at this temperature large pulsations are generated.

Figure 11:
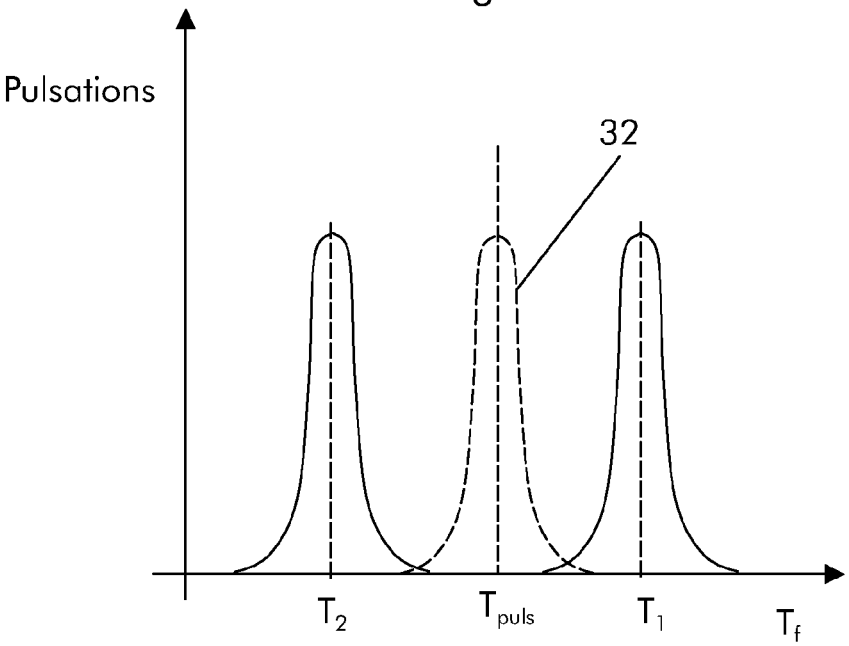
FIG. 11 shows the relationship between flame temperature ($T_f$) and pulsations for a combustion chamber in an embodiment of the invention operating at high load (not being full load)

FIG. 11 shows an example in which a combustion chamber should be operated with a flame temperature $T_{puls}$ to achieve the required power, but at this temperature large pulsations are generated (curve 32 indicates the pulsation distribution at a given flame temperature). In these cases typically it is not possible to operate the combustion chamber at the required power.

In contrast, a combustion chamber in embodiments of the invention can be operated with the first mixing devices generating flame with a temperature $T_1$ and the second mixing devices generating flames with a second temperature $T_2$, wherein the two temperatures $T_1$ and $T_2$ are astride of the temperature $T_{puls}$, their medium value is $T_{puls}$ and $T_1$ is higher than $T_2$.

With this operation since neither the flame 20, generated by the first mixing devices 11, nor the flame 21, generated by the second mixing devices 12, has the temperature $T_{puls}$, operation is safe but, at the same time, since their arithmetic medium is $T_{puls}$ the required power is achieved.

Modifications and variants in addition to those already stated are possible.

Figure 12:
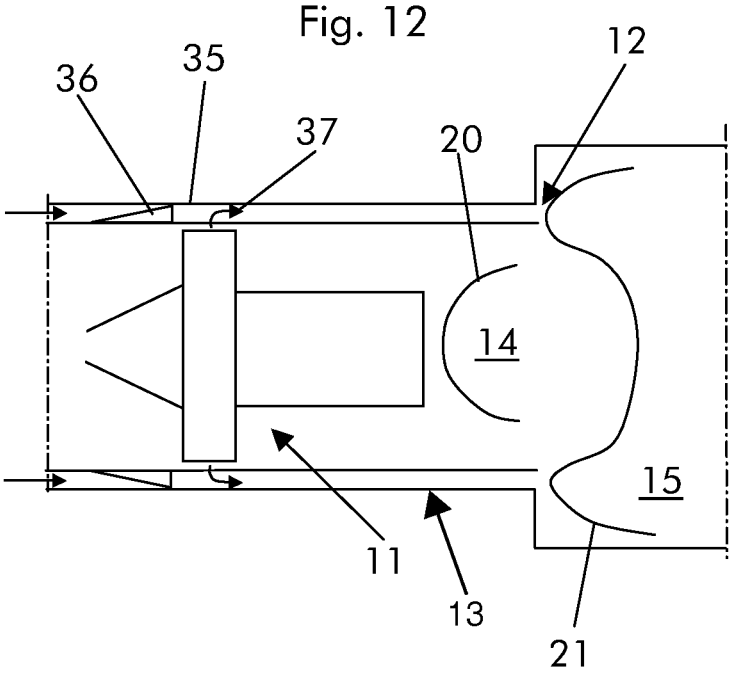
FIGS. 12-14 show combustion chambers in further embodiments of the invention.

For example FIG. 12 shows a combustion chamber with first mixing devices 11 supplying a mixture into the first zone 14 of the combustion chamber 13, and second mixing devices 12 supplying mixture into second zones 15 of the combustion device 13.

In particular the second mixing devices 12 are defined by a duct 35 with vortex generators 36 and fuel injectors 37; the duct 35 are long enough to allow mixing of the fuel and oxidiser before they enter the combustion device 13.

Figure 13:
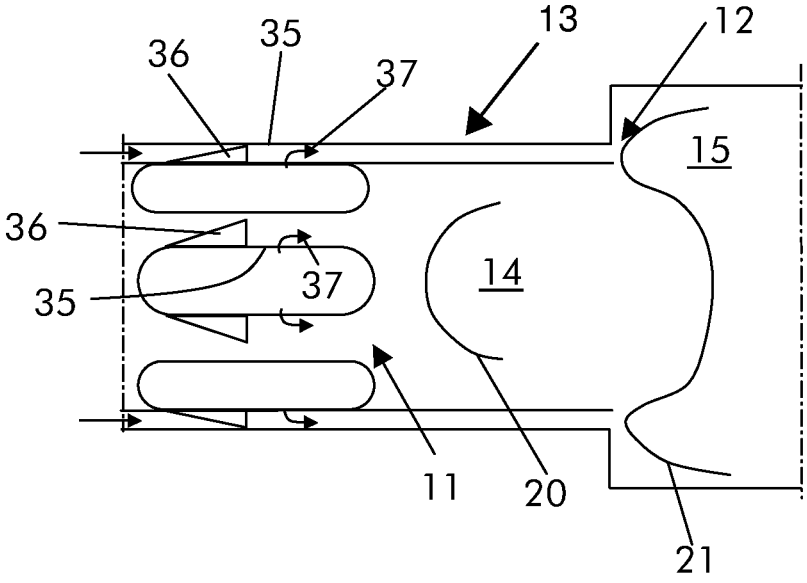

FIG. 13 shows a further example, in which both the first and the second mixing devices are defined by ducts 35 housing vortex generators 36 and fuel injectors 37.

Figure 14:
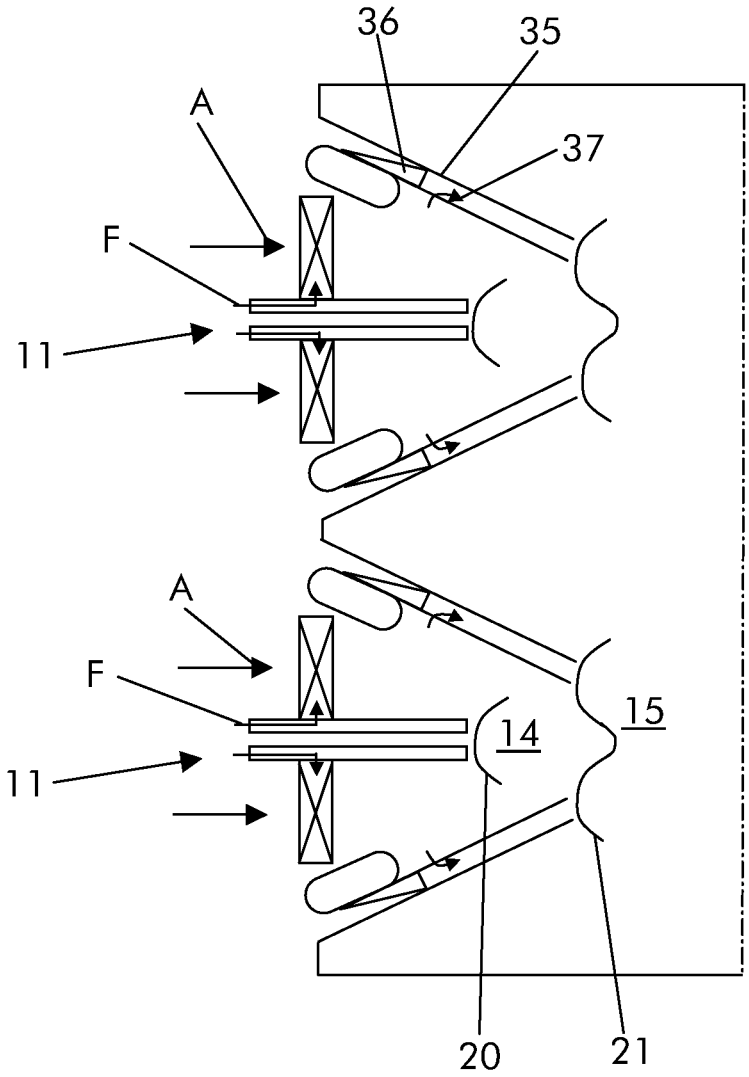

FIG. 14 shows a combustion chamber with first mixing devices 11 comprising radial swirl generator (that intimately mix fuel F and air A, and second fuel devices 12 comprising ducts 35, vortex generators 36 and fuel injectors 37.

In these figures, A indicates the oxidiser (typically air) and F the fuel.

The present invention also refers to a method of operating a combustion chamber of a gas turbine.

According to the method, the first fuel supply devices 11 and the second fuel supply devices 12 generate mixtures that are burnt generating flames 20, 21; the flame 20 generated by burning the mixture formed in the first fuel supply devices 11 is housed in the first zones 14 that are axially upstream of the second premixed fuel supply devices 12.

In addition, advantageously the flames 20, 21 have different temperatures.

In particular, the first fuel supply devices 11 are located upstream of the second fuel supply devices 12 and generate flames 20 having a higher temperature than the flame 21 generated by the second fuel supply devices 12.

In a first embodiment of the method, at part load the fuel supplied into the second fuel supply devices 12 is reduced, but the fuel supplied into the first fuel supply devices 11 is maintained constant. Then at low load (for example above 50% load) the second fuel supply devices 12 are switched off and only the first fuel supply devices 11 are operated.

In a second embodiment of the method, at part load the second fuel supply devices 12 are operated generating a flame with a temperature above a limit compatible with pulsation but below a limit compatible with CO emissions.

In a third embodiment of the method, at high part load the first and second fuel supply devices 11, 12 are operated generating flames with temperatures astride of a required flame temperature.

Naturally the features described may be independently provided from one another.

In practice the materials used and the dimensions can be chosen at will according to requirements and to the state of the art.

REFERENCE NUMERALS

1 combustion chamber
2*a*, 2*b* mixing devices
3 front plate
5 operating point
7 line
10 combustion chamber
11 first fuel supply devices
12 second fuel supply devices
13 combustion devices
14 first zones of 13
15 second zones of 15
16 combustion device longitudinal axis
17 longitudinal axis of 11
18 longitudinal axis of 12
20 first flame
21 second flame
25 flame temperature within zones 14
26 flame temperatures within zones 15
27, 28, 29 operating zones
30 flame temperature in a traditional gas turbine
32 pulsations distribution
35 duct
36 vortex generators
37 fuel injectors
A oxidiser
F fuel
G hot gases
$W_1$ operating window
$W_2$ operating window
$P_{min}$ minimum power
$P_{min,1}$ minimum power for traditional gas turbines
$P_{min,2}$ minimum power for gas turbines in embodiments of the invention
$T_f$ flame temperature
$T_p$ temperature below which pulsations are generated
$T_{puls}$ temperature at which large pulsations are generated
$T_{w1}$ lower limit for the flame temperature
$T_1$, $T_2$ temperature of the flame generated by the mixture formed in the first and second mixing device

What is claimed is:

1. A combustion chamber, of a gas turbine, comprising:

a plurality of first and second premixed fuel supply devices arranged in a first circumferential row, each of the plurality of first premixed fuel supply devices having a first longitudinal axis, each of the second premixed fuel supply devices having a second longitudinal axis, each of the first longitudinal axes and the second longitudinal axes of the first and second premixed fuel supply devices arranged at a same radial position from a central longitudinal axis, and wherein each of the first longitudinal axes and the second longitudinal axes of the first and second premixed fuel supply devices is parallel to one another, each first fuel premixed fuel supply device being adjacent to at least two second premixed fuel supply devices, and each of the plurality of first and second premixed fuel supply devices having a conical shape with tangential slots for air entrance within the first and second premixed fuel supply devices and nozzles close to the tangential slots for fuel injection, the first and second premixed fuel supply devices connected to a combustion device having first zones connected to the first premixed fuel supply devices and second zones connected to the second premixed fuel supply devices, wherein the second fuel supply devices are shifted along the central longitudinal axis with respect to the first fuel supply devices, the first zones are axially upstream of the second premixed fuel supply devices; and wherein flames generated in the first and second zones of the first and second premixed fuel supply devices are in the first and second zones, respectively, and the flames generated by the first premixed fuel supply devices are housed axially upstream of the second premixed fuel supply devices.

2. The combustion chamber as claimed in claim 1, wherein the first and second premixed fuel supply devices have different circumferential positions.

3. The combustion chamber as claimed in claim 1, wherein the first longitudinal axes of the first premixed fuel supply devices and the second longitudinal axes of the second fuel supply devices are also parallel to the central longitudinal axis.

4. The combustion chamber as claimed in claim 1, wherein the first and second premixed fuel supply devices inject a mixture along their parallel first and second longitudinal axes.

5. A method of operating a combustion chamber of a gas turbine having a plurality of first and second premixed fuel supply devices arranged in a first circumferential row, each of the plurality of first premixed fuel supply devices having a first longitudinal axis, each of the second premixed fuel supply devices having a second longitudinal axis, each of the first longitudinal axes and the second longitudinal axes of the first and second premixed fuel supply devices arranged at a same radial position from a central longitudinal axis, and wherein each of the first longitudinal axes and the second longitudinal axes of the first and second premixed fuel supply devices is parallel to one another, each first fuel premixed fuel supply device being adjacent to at least two second premixed fuel supply devices, and each of the plurality of first and second premixed fuel supply devices having a conical shape with tangential slots for air entrance within the first and second premixed fuel supply devices and nozzles close to the tangential slots for fuel injection, the first and second premixed fuel supply devices connected to a combustion device that has first zones connected to the first premixed fuel supply devices and second zones connected to the second premixed fuel supply devices, the method comprising:

arranging the second premixed fuel supply devices along the central longitudinal axis with respect to the first premixed fuel supply devices;

arranging the first zones axially upstream of the second premixed fuel supply devices; and feeding a fuel and an oxidizer into the first and second premixed fuel supply devices to generate a mixture that is burnt within the combustion device, and wherein flames generated in the first and second zones of the first and second premixed fuel supply devices are in the first and second zones, respectively, and the flames generated by the first premixed fuel supply devices are housed axially upstream of the second premixed fuel supply devices.

6. The method according to claim 5, wherein the first fuel supply devices and the second fuel supply devices generate flames having different temperatures.

7. The method according to claim 5, wherein the flames generated by the first premixed fuel supply devices have a higher temperature than the flames generated by the second premixed fuel supply devices.

8. The method according to claim 7, wherein at part load, fuel supplied into the second premixed fuel supply devices is reduced, but fuel supplied into the first premixed fuel supply devices is maintained constant.

9. The method according to claim 7, wherein at low load the second premixed fuel supply devices are switched off and only the first premixed fuel supply devices are operated.

10. The method according to claim 7, wherein at part load the second premixed fuel supply devices are operated generating flames with temperature above a limit compatible with pulsation but below a limit compatible with CO emissions.

11. The method according to claim 7, wherein at high part load the first and second premixed fuel supply devices are operated generating flames with flame temperatures astride of a required flame temperature.

12. The combustion chamber as claimed in claim 1, wherein the fuel injected through the nozzles is a gaseous fuel.

13. The combustion chamber as claimed in claim 1, comprising:

lances extending axially within the first and second premixed fuel supply devices for injecting a liquid fuel.

14. The method according to claim 5, wherein the fuel injected through the nozzles is a gaseous fuel.

15. The method according to claim 5, comprising:

injecting a liquid fuel through lances extending axially within the first and second premixed fuel supply devices.

16. The combustion chamber as claimed in claim 1, further comprising a second circumferential row of the plurality of first and second premixed fuel supply devices.

17. The method according to claim 5, further comprising a second circumferential row of the plurality of first and second premixed fuel supply devices.

* * * * *